US006880261B1

(12) United States Patent
Abbey

(10) Patent No.: US 6,880,261 B1
(45) Date of Patent: Apr. 19, 2005

(54) FLEXIBLE AND COLLAPSIBLE CONSTRUCTION GEOMETRY TOOL

(76) Inventor: John D. Abbey, 923 Tahoe Blvd., #212, Incline Village, NV (US) 89451

( * ) Notice: Subject to any disclaimer, the term of this patent is extended or adjusted under 35 U.S.C. 154(b) by 0 days.

(21) Appl. No.: 10/460,517

(22) Filed: Jun. 11, 2003

(51) Int. Cl.[7] ..... G01B 3/10
(52) U.S. Cl. ..... 33/759; 33/1 G; 33/413
(58) Field of Search ..... 33/759, 1 G, 413, 33/429

(56) References Cited

U.S. PATENT DOCUMENTS

| | | | | | |
|---|---|---|---|---|---|
| 735,128 | A | | 8/1903 | Murphy | |
| 738,224 | A | | 9/1903 | Morse | |
| 912,605 | A | | 2/1909 | Osmonson | |
| 989,806 | A | | 4/1911 | Robertson et al. | |
| 1,027,766 | A | | 5/1912 | Robertson et al. | |
| 1,040,239 | A | | 10/1912 | Raren | |
| 1,046,362 | A | | 12/1912 | Adams | |
| 1,640,604 | A | | 8/1927 | Hauber | |
| 1,999,105 | A | | 4/1935 | Milla | |
| 2,160,820 | A | | 6/1939 | Bensen | |
| 2,206,760 | A | | 7/1940 | Ballard | |
| 2,507,460 | A | | 5/1950 | Schacht | |
| 4,160,324 | A | * | 7/1979 | Dunn | 33/759 |
| 4,566,198 | A | * | 1/1986 | Vitale | 33/759 |
| 4,575,943 | A | * | 3/1986 | Baum, Jr. | 33/759 |
| 4,916,822 | A | | 4/1990 | Johnson | |
| 5,107,595 | A | * | 4/1992 | Stay et al. | 33/1 G |
| 5,371,949 | A | * | 12/1994 | Delaurier | 33/1 G |
| 5,384,967 | A | | 1/1995 | Helmuth | |
| 5,414,938 | A | | 5/1995 | Meek | |
| 5,539,991 | A | | 7/1996 | Harrison | |
| 5,669,149 | A | | 9/1997 | Meitzler | |
| 5,732,474 | A | | 3/1998 | Cannon | |
| 5,778,546 | A | * | 7/1998 | Williamson | 33/413 |
| 5,974,677 | A | | 11/1999 | Butwin | |
| 6,209,213 | B1 | | 4/2001 | Moe | |
| 6,470,582 | B1 | * | 10/2002 | Renko | 33/1 G |

* cited by examiner

*Primary Examiner*—Christopher W. Fulton
(74) *Attorney, Agent, or Firm*—Heisler & Associates

(57) ABSTRACT

A tool is provided for laying out precise angles in construction of structures such as a foundation. The tool includes three corners including a first corner, a second corner and a third corner. Each of the corners are spaced from each other by separate strands including a first strand, a second strand and a third strand. Each of the strands are inelastic so that when fully extended they have a precise length. The lengths of the three strands are precisely provided so that the tool is provided in the form of a triangle with angular measurements of each of the corners precisely as desired. Preferably, one of the corners measures exactly 90° to facilitate the forming of a structure with a foundation having corners which measure precisely 90°.

28 Claims, 3 Drawing Sheets

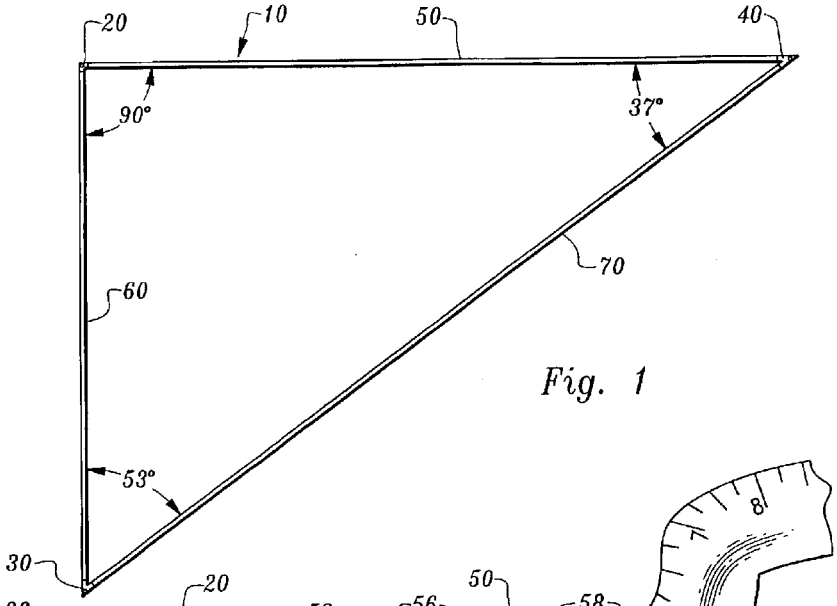
Fig. 1
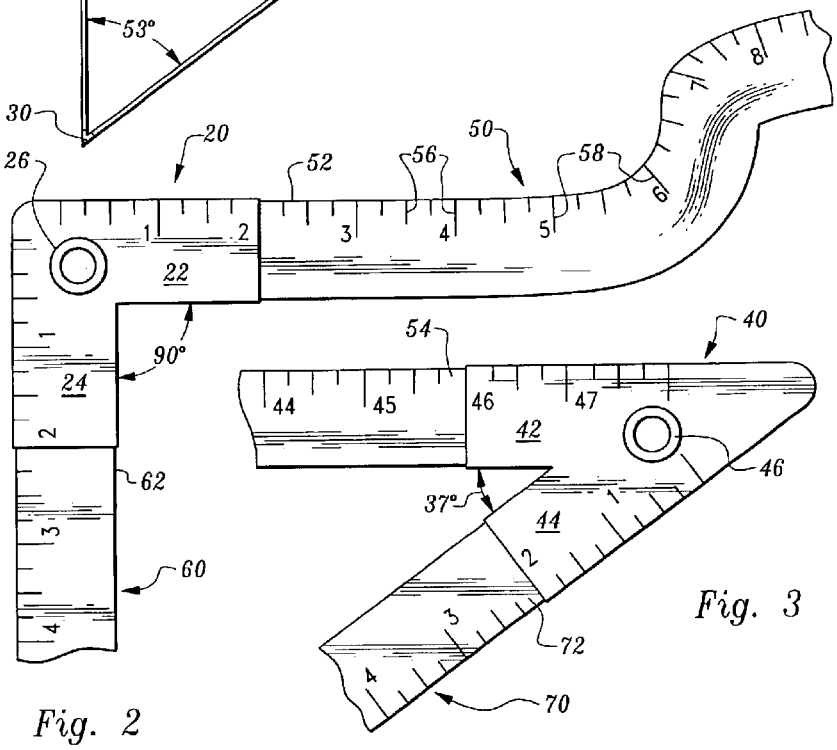
Fig. 2
Fig. 3

110
170
130
N
140
160
150
120
B
G
S 110
135°
45°
225°
F
90°

FLEXIBLE AND COLLAPSIBLE CONSTRUCTION GEOMETRY TOOL

FIELD OF THE INVENTION

The following relates to tools for use in constructing foundations and other portions of structures with desired geometries. More particularly, this invention relates to tools for assisting in the layout of foundations of structures so that angles in the foundations of the structures, and particularly square corners of the structures, are precisely square or otherwise angularly measured precisely as desired.

BACKGROUND OF THE INVENTION

In laying out the foundations of structures, and particularly residential structures and related structures, it is important that the foundation be square, or otherwise have a geometry precisely matching a desired geometry for the foundation and for the structure. Most commonly, corners of the foundation are square corners measuring 90°. While numerous tools are in existence for assisting in the layout of 90° "square" corners, each of these tools has certain drawbacks.

"Carpenter's square" type devices are known which are typically in the form of a large "L" formed of rigid metal or other material. While these "carpenter's squares" do precisely measure 90°, the legs of the carpenter's square are not particularly long, typically no longer than two or three feet. Even the smallest structures will typically extend significantly beyond the ends of the legs of a carpenter's square. Hence, the foundation must be carefully extended linearly beyond the carpenter's square so that a properly square corner is provided. Even when a carpenter's square is precisely utilized, most commonly some degree of error results when the sides of the structure adjacent the square corner are extended.

Surveying equipment can be utilized, such as a transit, to precisely lay out the corners of the structure where desired. Typically however, such surveying tools are most effective when a team of surveyors can work together. When a single worker wishes to lay out the foundation alone, use of such surveying equipment involves numerous trips back and forth between the surveyor's transit and the location being measured. Also, such surveying equipment requires a certain level of surveying skill beneficially practiced by surveying professionals, rather than less skilled users.

Another option is to use some form of protractor to measure the 90° angle or other angle of the corner. Even a large protractor will have the same deficiency as the carpenter's square, in that when the sides of the structure adjacent the corner are extended, they will rarely precisely have the measurement desired.

Often foundation builders will utilize geometric techniques to measure out the sides of form boards for use in pouring cementitious material to form the foundation, so that the proper 90° is provided. For instance, it is known that a triangle having a first leg a multiple of three feet long, a second leg a multiple of four feet long and a hypotenuse leg a multiple of five feet long (i.e. 3 ft.×4 ft.×5 ft. or 6 ft.×8 ft.×10 ft.) will have a corner between the first leg and the second leg measuring precisely 90°. While this technique is effective, it requires a significant amount of time to implement, significantly delaying the process of laying out and forming the foundation of the structure.

Specifically, after identifying a position for the tip of the square corner, a first side adjacent the corner is provided with a reference stake or other structure three feet (or six feet, nine feet, etc.) away from the tip of the corner and in the desired direction. Once this first side adjacent the corner has been positioned, the second side is laid out in a position which appears approximately 90° away from the first side to be located adjacent the corner. This second side is marked at a distance four feet (or eight feet, twelve feet, etc.) away from the tip of the corner. A measurement is then taken from the first reference point at the end of the first side to the second reference point at the end of the second side. If it measures precisely five feet (or ten feet, fifteen feet, etc.) then the corner is precisely 90°. However, if it is slightly greater than or less than five feet (or ten feet, fifteen feet, etc.) the second reference point and second side must be adjusted, such as by trial and error. While this technique is generally effective, it takes a significant amount of time to implement in practice.

Accordingly, a need exists for quickly and easily precisely laying out foundations for structures which are precisely square or otherwise having properly angled corners.

SUMMARY OF THE INVENTION

This invention provides a tool for quickly and easily laying out square corners and other corners of a foundation with precise angular measurements. The tool is in the form of a triangle formed of elongate flexible inelastic strands, such as flexible measuring tape strands. The triangular tool has a first corner, second corner and third corner each mutually spaced from each other and coupled together by a first flexible strand, a second flexible strand and a third flexible strand. The strands have precise lengths so that when each of the strands are fully extended angles adjacent the corners and between adjacent strands are precisely provided.

For instance, if the tool is in the form of a "3-4-5 triangle," the first strand might be eight feet long when fully extended, the second tape might be six feet long when fully extended and the third tape might be ten feet long when fully extended. The corner between the first tape and the second tape would thus measure precisely 90° when each of the strands are fully extended. Alternatively, the tool can be provided in the nature of a "30-60-90 triangle" so that when each of the tapes are fully extended the angle adjacent the first corner is 90°, the angle adjacent the second corner is 60° and the angle adjacent the third corner is 30°. In the same manner other angular measurements can be provided, such as if each of the strands are of similar length angular measurements of exactly 60° are provided between each of the three tapes.

Each of the corners are preferably reinforced to allow for firm attachment of the tapes thereto. Also, each of the corners preferably include a grommet to both securely hold each of the tapes together and to provide a hole passing through the corner. This hole provides a convenient location for a nail or other temporary fastener to pass vertically into a form board for the pouring of a concrete foundation or for a nail passing into a stake used in the laying out of the foundation, or for a spike to pass which is driven directly into the ground.

Each of the tapes preferably includes graduations thereon with indicia adjacent at least some of the graduations. The graduations and indicia are positioned and numbered to indicate distances from at least one of the grommets in one of the corners adjacent each tape. Thus, the tool doubles as a tape measure to some extent in addition to assisting in laying out corners with proper angular measurements.

OBJECTS OF THE INVENTION

Accordingly, a primary object of the present invention is to provide a tool to assist in precisely laying out corners of a foundation of a structure to be built.

Another object of the present invention is to provide a foundation corner layout tool which can be utilized by a single user to efficiently and precisely lay out corners of a foundation of a structure to be built.

Another object of the present invention is to provide a construction geometry tool which provides both precise angular measurements and precise distance measurements.

Another object of the present invention is to provide a construction geometry tool which can be collapsed into a small space.

Another object of the present invention is to provide a construction geometry tool which is lightweight.

Other further objects of the present invention will become apparent from a careful reading of the included drawing figures, the claims and detailed description of the invention.

BRIEF DESCRIPTION OF THE DRAWINGS

FIG. 1 is a top plan view of the construction geometry tool of this invention with the three corners and three tapes of the tool each positioned as they would be when each of the tapes are fully extended.

FIG. 2 is a detail of a portion of that which is shown in FIG. 1 revealing details of a first corner of the tool of this invention and illustrating a flexibility of the first tape of the tool.

FIG. 3 is a detail of a third corner of the tool of FIG. 1.

DESCRIPTION OF THE PREFERRED EMBODIMENT

Figure 5:
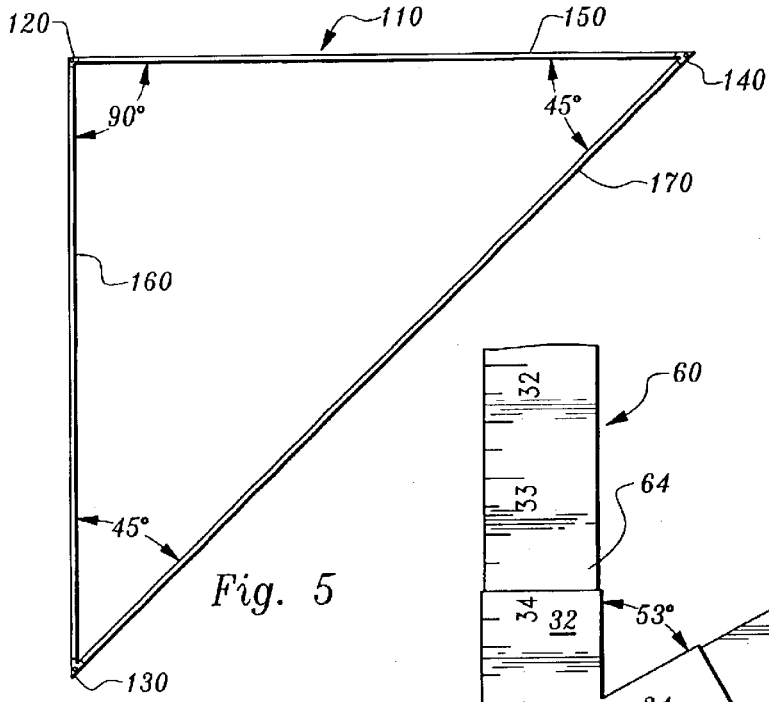
FIG. 5 is a top plan view of an alternative embodiment of that which is shown in FIG. 1 which has a 90° corner and two 45° corners.
Figure 4:
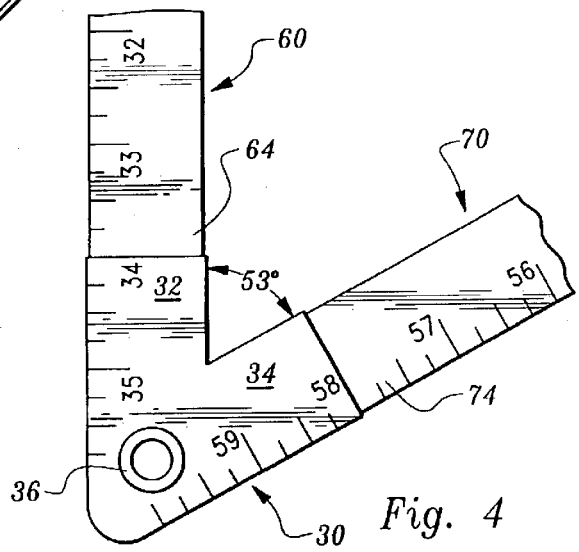
FIG. 4 is a detail of the second corner of the tool of FIG. 1.
Figure 6:
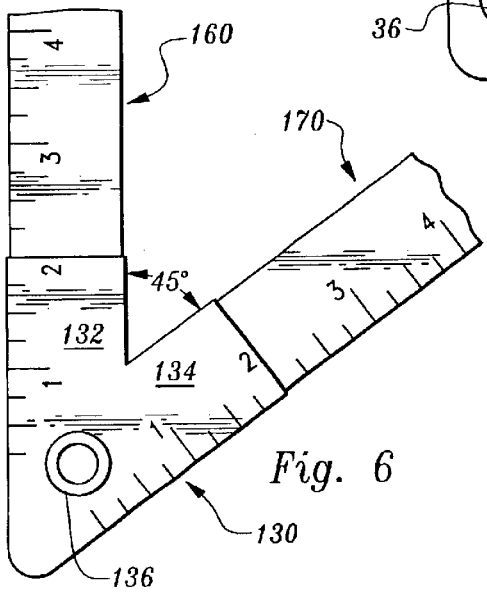
FIG. 6 is a detail of a portion of one of the 45° corners of the tool of FIG. 5.

Referring to the drawings, wherein like reference numerals represent like parts throughout the various drawing figures, reference numeral 10 is directed to a construction geometry tool (FIG. 1) which can be utilized to quickly and precisely lay out corners of a foundation of a structure (FIG. 7) with proper angular measurements. The tool 10 is formed of tapes 50, 60, 70 which are flexible but which are inelastic to resist elongation thereof. The tool 10 can thus be collapsed into a small space and later deployed with each of the tapes 50, 60, 70 fully extended so that desired angular measurements are provided by corners of the triangle represented by the tool 10.

In essence, and with particular reference to FIGS. 1–4, basic details of the construction geometry tool 10 of this invention are described. The construction geometry tool 10 is preferably generally in the form of three separate tape measures joined together at corners thereof to form a triangle having desired angular measurements. The tool 10 thus includes a first square corner 20, a second corner 30 spaced from the first corner 20 and a third corner 40 spaced from the first corner 20 and the second corner 30. A first tape 50 is coupled to the first corner 20 and the third corner 40. A second tape 60 is coupled to the first corner 20 and the second corner 30. A third tape 70 is coupled to the second corner 30 and the third corner 40.

The material forming the tapes 50, 60, 70 is flexible to allow the tapes 50, 60, 70 to be collapsed. However, the material forming the tapes 50, 60, 70 is preferably inelastic, at least in a longitudinal direction, such that the tapes 50, 60, 70 cannot be substantially elongated beyond a full length of the tapes 50, 60, 70. Thus, when the tapes 50, 60, 70 are each fully extended they always produce the same angular measurements adjacent the corners 20, 30, 40.

The lengths of the tapes 50, 60, 70 are selected to provide desired angular measurements adjacent the corners 20, 30, 40. Most preferably according to a preferred embodiment of this invention the first corner 20 is square with an angular measurement of 90°. Thus, when the tapes 50, 60, 70 are each fully extended the tool 10 has the first corner 20 as a precise square corner to assist in the laying out of a square corner of a foundation.

More specifically, and with particular reference to FIGS. 1–4, specific details of the construction geometry tool 10 are described. The first square corner 20 is preferably provided in the form of a reinforcement structure with the first tape 50 and the second tape 60 coupled to this first square corner 20. The first square corner 20 is thus defined as a rigid construct having a first leg 22 (FIG. 2) extending toward the third corner 40 and a second leg 24 extending toward the second corner 30. By providing the first square corner 20 in the form of a substantially rigid reinforcement structure, the strength of the tool 10 adjacent the first square corner 20 is enhanced. Alternatively, the first square corner 20 can be provided merely by sewing the first tape 50 to the second tape 60 or otherwise attaching the first tape 50 to the second tape 60, such as by rivets, staples, weaving of fabric forming the first tape 50 and second tape 60 directly together, adhesive, or other fasteners.

Preferably, a grommet 26 passes through the first square corner 20. The grommet 26 preferably passes entirely through the first square corner 20 with a hole sized to allow a nail or other removable attachment structure to pass therethrough, such as to attach the first square corner 20 to the ground or to a form board adjacent the first square corner 20. A center of the grommet 26 is preferably positioned at a midpoint between the first leg 22 and the second leg 24 of the square corner 20. The grommet 26 provides a preferred form of a means to removably attach the first corner 20 of the tool 10 to an adjacent structure. Other such removable attachment means could include hooks, posts, pins or holes formed in other fashions besides the placement of the grommet 26 at the first square corner 20.

The second corner 30 (FIG. 4) is preferably provided in a manner similar to that of the first square corner 20, except that angular measurement of the second corner 30 is different due to different lengths of the second tape 60 and third tape 70 adjacent the second corner 30. The second corner 30 thus includes the first leg 32 (FIG. 4) spaced from a second leg 34. A grommet 36 passes through the second corner 30. The second corner 30 preferably is in the form of a reinforced structure similar to that of the first square corner 20. The grommet 36 is preferably located at a midpoint between the first leg 32 and the second leg 34 with features of the grommet 36 mirroring those of the grommet 26 of the first square corner 20. When the tool 10 according to the preferred embodiment is in the form corresponding with that of a "3-4-5" triangle, the angle between the first leg 32 and second leg 34 of the second corner 30 measures approximately 53 degrees.

The third corner 40 (FIG. 3) is formed similar to that of the first corner 20 and second corner 30, except with attachment to the first tape 50 and third tape 70 and with a different angular measurement corresponding with a length of the first tape 50 and the third tape 70. Particularly, the third corner 40 includes a first leg 42 and a second leg 44 angularly spaced from each other by approximately 37°. A grommet 46 is located at a midpoint between the first leg 42 and the second leg 44 with the grommet 46 generally similar to that of the grommet 26 of the first square corner 20. Preferably, each of the corners 20, 30, 40 are generally indistinguishable from each other, other than the angular measurements of the legs thereof relative to each other.

The first tape 50 provides a preferred form of intermediate structure or strand joining the first square corner 20 to the third corner 40. The first tape 50 preferably is generally in the form of a flexible fabric measuring tape with insubstantial thickness and a constant width between a first end 52 and a second end 54. The first end 52 (FIG. 2) is coupled to the first square corner 20. The second end 54 (FIG. 3) is coupled to the third corner 40.

The first tape 50 has a precise length selected to cause the tool 10 to have desired angular measurements between the corners 20, 30, 40. Particularly, the first tape 50 is preferably eight feet long (or some other multiple of four feet) between the first end 52 and the second end 54.

The first tape 50 preferably includes graduations 56 thereon. The graduations 56 are preferably provided in the form of printing directly onto each side of the first tape 50. Indicia 58 are printed adjacent some of the graduations 56. The indicia 58 adjacent each graduation 56 indicate a distance that the adjacent graduation 56 is spaced from one of the ends of the first tape 50.

Preferably, the graduations 56 and indicia 58 are precisely spaced from the grommet 26 in the first square corner 20 and the grommet 46 in the third corner 40. Preferably, the graduations 56 are provided at one inch intervals with at least forty-nine graduations (including a "zero" graduation) between the first square corner 20 and the third corner 40. Preferably, an indicia 58 is located adjacent most graduations 56 which are at one of these one inch intervals between the first square corner 20 and the third corner 40.

Preferably, additional smaller graduations 56 are provided between the graduations 56 having indicia 58 adjacent thereto. These additional graduations 56 preferably identify half-inch spacing and quarter-inch spacing (and optionally finer spacings) between the graduations 56 which have the indicia 58 adjacent thereto. Preferably, the graduations 56 which are not at one inch intervals from the first square corner 20 and the third corner 40 do not include indicia adjacent thereto.

Preferably, the graduations 56 are actually precisely spaced from a side wall of a center hole passing through each grommet 26, 46 in the first square 20 and the third corner 40. In this way, the graduations 56 will be precisely located at the distance indicated by the indicia 58 away from a nail or other vertical support passing through the hole in the middle of each grommet 26, 36, when the first tape 50 is fully extended.

The second tape 60 is preferably similar to the first tape 50 except that it extends between the first square corner 20 and the second corner 30. The second tape 60 includes a first end 62 (FIG. 2) coupled to the first square corner 20 and a second end 64 (FIG. 4) coupled to the second corner 30. The second tape 60 is preferably six feet long (or other increment of three feet). The second tape 60 preferably includes graduations and indicia thereon indicative of a spacing away from the grommet 26 in the first square corner 20. Other details of the second tape 60 are similar to those of the first tape 50.

The third tape 70 extends between the second corner 30 and the third corner 40. The third tape 70 includes a first end 72 adjacent the third corner 40 (FIG. 3) and a second end 74 (FIG. 4) adjacent the second corner 30. The third tape 70 is preferably ten feet long between the first end 72 and the second end 74 (or other increments of five feet) to complete the "3-4-5" triangle form of the tool 10. For simplicity, the indicia 58 shown in FIGS. 1–4 are representative of a "3-4-5" triangle form of the tool 10 where the first tape 50 is four feet long, the second tape 60 is three feet long and the third tape 70 is five feet long, and where each of the graduations 56 and indicia 58 are laid out in the form of inches.

While the tapes 50, 60, 70 are preferably in the form of flexible fabric or other woven material (i.e. fiberglass) with some form of lamination or other sealing of surfaces thereof, the tapes 50, 60, 70 could be replaced with other intermediate structures or other strands joining the corners 20, 30, 40 together. For instance, string formed of a material which is not significantly elastic, but which is flexible, could be utilized in place of one or more of the tapes 50, 60, 70. Also, some of the corners 20, 30, 40 could be rigidly joined together with elongate rigid structures such as with a rigid ruler, with other corners joined together by flexible strands either in the form of the tapes 50, 60, 70 or in the form of string, or other flexible structure to couple the corners 20, 30, 40 together. When these flexible strands or other structures joining the corners 20, 30, 40 together are fully elongated, they provide the corners 20, 30, 40 with the desired angular measurements for layout of the structure.

While the preferred tool 10 includes the first corner 20 in the form of a square corner 20 with a 90° angular measurement, and with the second corner 30 and third corner 40 corresponding with corners present in a "3-4-5 triangle," alternative tools 10 could be provided with different angular measurements and different lengths. For instance, alternative tools 10 could be provided in the form of a "30-60-90 triangle" such that a first square corner could be provided having a 90° measurement and with a second corner with a 60° measurement and third corner with a 30° measurement. Such an alternative "30-60-90" tool would be beneficial in laying out a structure that includes both 90° angles and either 30° angles or 60° angles. For instance, a structure which includes honeycomb or hexagon type structures either alone or in combination with square or rectangular "90°" corners would benefit from such a "30-60-90" tool.

Other tools could be provided with other precise angle measurements where a structure to be constructed having such particular measurements, so that the second and third corners of the tool can be provided for laying out these unique corners, while still providing a 90° first square corner.

As another alternative, a tool could be provided which does not include a 90° square corner. For instance, a tool could be provided generally in the form of an equilateral triangle with an angular measurement of each corner being 60° and with each tape or other strand being of similar length.

Illustrative of an alternative tool is a 45° tool 110 shown in detail in FIGS. 5–8, and particularly useful in structures that have both 90° "square" corners as well as angles which are multiples of 45°, including 45° corners, 135° corners, 225° corners, etc. With particular reference to FIGS. 5–8, details of such a 45° tool 110 are described.

The tool 110 is generally similar to the tool 10 except for the angular measurements provided thereby. Particularly, the tool 110 includes a first square corner 120 (FIG. 5) generally similar to the first square corner 20 of the tool 10 of the preferred embodiment (FIGS. 1 and 2). A second corner 130 (FIGS. 5 and 6) is spaced from the first square corner 120. A third corner 140 is spaced from the first square corner 120 and the second corner 130. Both the second corner 130 and third corner 140 have 45° angle measurements associated therewith (FIG. 5).

The second corner 130 (FIG. 6) preferably includes a first leg 132 spaced from a second leg 134 by an angular measurement of 45°. A grommet 136 is provided at a midpoint between the first leg 132 and the second leg 134. Other details of the second corner 130 are similar to those of the corners 20, 30, 40 of the tape 10 of the preferred embodiment (FIGS. 1–4). The third corner 140 is preferably identical to the second corner 130 except that it joins the first tape 150 to the third tape 170 while the second corner 130 joins the second tape 160 to the third tape 170.

Figure 7:
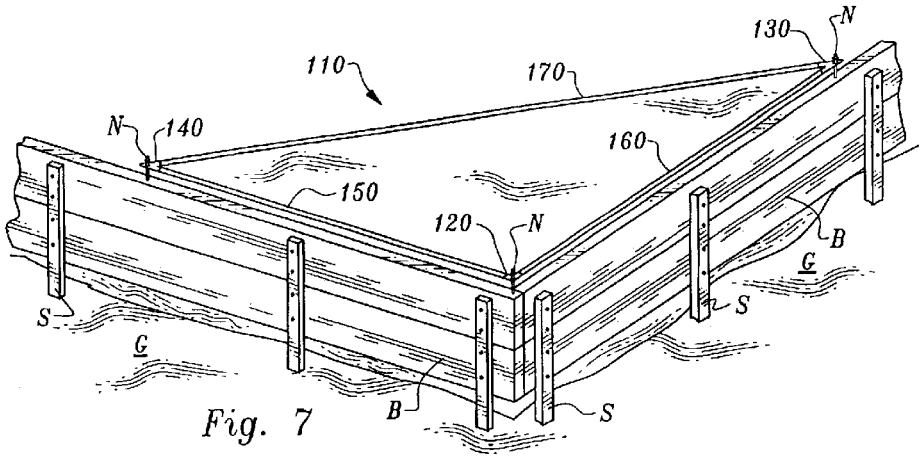
FIG. 7 is a perspective view of a foundation in the process of being laid out utilizing the tool of FIG. 5.
Figure 8:
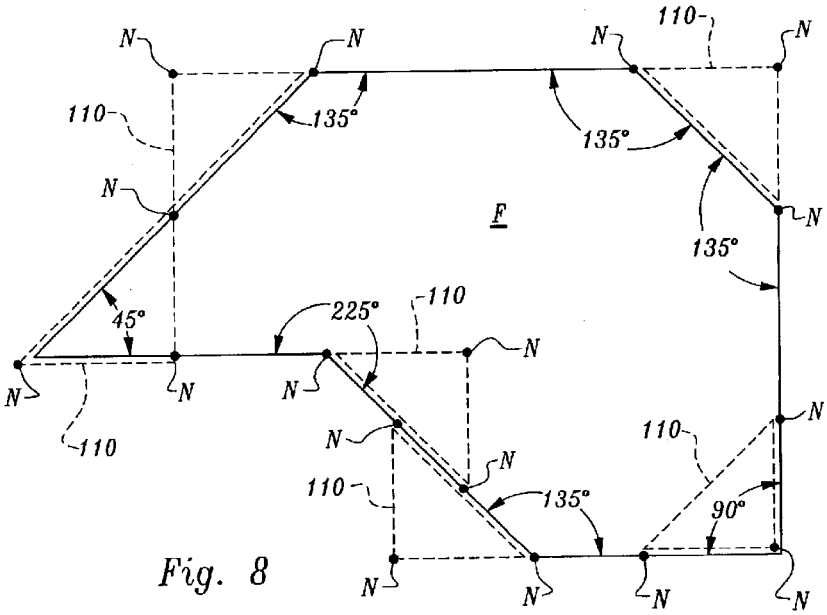
FIG. 8 is a top plan view of a foundation having numerous unique corners therein and illustrating how the single tool of FIG. 5 can be utilized to properly lay out each of the unique corners of the foundation shown therein.

In use and operation, and with particular reference to FIGS. 7 and 8, details of the manner of use of the construction geometry tool 10 and the 45° tool 110 of this invention and other similar construction geometry tools, are described. Initially, a foundation F is identified which is desired to be constructed (FIG. 8). This foundation F will include linear sides joined together by corners having different angular measurements. FIG. 8 illustrates a particularly unusual geometric form for a foundation F utilizing various different variations on 45° angles therein. Other foundations having a more hexagonal form to them might have various angles which are multiples of 30°, and would beneficially utilize a "30-60-90 triangle" tool as described above.

A first corner of the foundation F is initially identified. A desired location for this corner is laid out on the ground G and marked, such as with a stake S, or by the placement of form boards B along a side adjacent this corner and with one end of the form boards B (FIG. 7) located at the desired location for the corner to be laid out. The stakes S hold the form boards B in a vertical orientation above ground G before the pouring of cementitious material to form a foundation F for the structure.

The first square corner 120 of the tool 110 is then placed adjacent the top of the form board B and a nail N or other removable fastener is passed through the grommet 46 in the first square corner 120, similar to the grommet 26 of the first square corner 20 of the tool 10 of the preferred embodiment (FIG. 2). This nail N then passes into the top of the form board B. The 45° tool 110 is then laid out so that each of the tapes 150, 160, 170 are each fully elongated.

The third corner 140 is located directly adjacent a top edge of the form board B which has already been laid out along a side adjacent the corner of the foundation F (FIG. 8) to be formed. A nail is then passed through a grommet or other attachment structure in the third corner 140 to secure the third corner 140 adjacent the top of the form board B. The second corner 130 is then located with each of the tapes 150, 160, 170 fully elongated. Form boards B are then placed above the ground G with stakes S precisely where necessary to allow a nail N to pass through the second corner 130 and into the top of the form board B. When the form board B is positioned beneath the second corner 130, the corner adjacent the first square corner 120 of the tool 110 will be provided by the form boards B with an exactly 90° angle.

Preferably, the lengths of the tapes 150, 160, 170 are sufficiently long that the sides adjacent this corner can be extended in a straight forward fashion to the length desired for these sides adjacent the corner laid out for the foundation F. When the appropriate distances of these sides have been measured out, the form boards B are provided out to that point. The ends of these form boards then provide new corner locations for further laying out of the foundation F.

FIG. 8 generally depicts with dashed lines where various different 45° tools 110 would be positioned and attached with nails N to properly lay out 90° corners, 135° corners, 225° corners and 45° corners for the foundation F shown in FIG. 8. One skilled in the art can readily discern how the tool 110 could similarly be utilized for other foundations F having different layouts with a combination of 45° angles or 90° angles or 135° angles or 225° angles for the foundation F.

Once all of the form boards B have been positioned where desired, cementitious material can then be poured so that the foundation F will have the precise geometry desired. The tool 110 is easily removed by removal of the nails N or allowing heads of the nails N to pass through the grommets of the tool 110 to allow the tool 110 to be removed therefrom. The tool 110 can then be reused either at other corners of the foundation F or collapsed for storage before later reuse on other structures.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A flexible and collapsible construction geometry tool, comprising in combination:

a first corner;

a second corner spaced from said first corner;

a third corner spaced from said first corner and said second corner;

a first flexible strand of constant length having a first end permanently affixed to said first corner and a second end permanently affixed to said third corner;

a second flexible strand of constant length having a first end permanently affixed to said first corner and a second end permanently affixed to said second corner; and a third flexible strand of constant length having a first end permanently affixed to said third corner and a second end permanently affixed to said second corner.

2. The tool of claim 1 wherein said first corner is square when said first flexible strand, said second flexible strand and said third flexible strand are each fully extended.

3. The tool of claim 1 wherein at least one of said strands is a tape.

4. The tool of claim 3 wherein said first strand, said second strand and said third strand are each tapes, with at least one said tape in the form of a measuring tape including graduations therealong with indicia correlating with distances along said tapes adjacent a plurality of said graduations.

5. The tool of claim 4 where at least one said tape is formed of a flexible fabric material incapable of exhibiting rigidity.

6. The tool of claim 1 wherein each said corner includes a grommet therein.

7. The tool of claim 6 wherein each said corner is formed of a stronger material than material forming said strands, such that said corners are reinforced.

8. The tool of claim 7 wherein said first strand, said second strand and said third strand are each tapes, with each said tape in the form of a measuring tape including graduations therealong with indicia correlating with distances along said tapes adjacent a plurality of said graduations.

9. The tool of claim 8 wherein each said corner includes a first leg spaced angularly from a second leg, with each said leg formed of a material less flexible than said strands and each said leg coupled to a different strand.

10. The tool of claim 9 wherein said grommet in each said corner is located with a center of said grommet aligned with a centerline of each said leg of each said corner.

11. The tool of claim 10 wherein said graduations and said indicia are positioned relative to a location of said grommets, such that said indicia are representative of a distance each said graduation adjacent said indicia is spaced away from at least one said grommet and at least one said corner coupled to said tape in which said graduations and said indicia are provided.

12. The tool of claim 6 wherein said first strand, said second strand and said third strand are each formed of a material which is substantially inelastic linearly, such that said strands cannot be significantly elongated when tension loads are applied along a length of said strands.

13. The tool of claim 1 wherein said first flexible strand, said second flexible strand and said third flexible strand have lengths which are each different from each other and correlated according to the ratio 3:4:5, such that a "3-4-5 triangle" is provided when each of said strands are fully extended.

14. The tool of claim 1 wherein said first flexible strand and said second flexible strand are of similar lengths and said third flexible strand has a length sufficient to cause an angle between said first strand and said second strand to be 90° and angles between said first strand and said third strand and between said second strand and said third strand to each be 45° when each of said strands are fully extended.

15. The tool of claim 1 wherein said first strand, said second strand and said third strand each have lengths selected to cause an angle between said first strand and said second strand to be 90°, an angle between said first strand and said third strand to be 30° and an angle between said second strand and said third strand to be 60°, when each of said strands are fully extended.

16. The tool of claim 1 wherein said first strand, said second strand and said third strand are each of similar length.

17. The tool of claim 1 wherein said first strand, said second strand and said third strand are each formed of a material which is substantially inelastic linearly, such that said strands cannot be significantly elongated when tension loads are applied along a length of said strands.

18. A construction geometry tool comprising in combination:

a first corner;

a second corner spaced from said first corner;

a third corner spaced from said first corner and said second corner;

said first corner and said third corner joined together by a first intermediate structure of constant length permanently affixed to said first corner and said third corner;

said first corner and said second corner coupled together by a second intermediate structure of constant length permanently affixed to said first corner and said second corner;

said second corner and said third corner coupled together by a third intermediate structure of constant length permanently affixed to said second corner and said third corner; and each of said intermediate structures in the form of a flexible strand of fixed length formed of a material which is substantially inelastic linearly with said flexible strand having a first end permanently affixed to one of said corners and a second end affixed to one of said corners.

19. The tool of claim 18 wherein said intermediate structures are adapted to maintain fixed angles relative to adjacent intermediate structures at each of said corners when said intermediate structures are deployed in a fully elongated orientation.

20. The tool of claim 18 wherein said flexible strands are in the form of measuring tapes with graduations thereon and indicia adjacent a plurality of said graduations, said indicia indicative of a distance said graduations adjacent said indicia are spaced from ends of said flexible strands.

21. The tool of claim 20 wherein said ends of said flexible strands include grommets therein with holes passing therethrough and with said graduations and said indicia positioned relative to at least one of said grommets so that said indicia are representative of a distance said graduations are spaced from at least one of said grommets.

22. The tool of claim 18 wherein at least one of said corners includes a grommet therein with a hole passing through said grommet.

23. A method for laying out a foundation of a structure with corners of the structure having angular measurements precisely matching desired angular measurements for the structure, the method including the steps of:

providing a tool including a first corner, a second corner spaced from the first corner, a third corner spaced from the first corner and the second corner, a first flexible strand of constant length having a first end permanently affixed to the first corner and a second end permanently affixed to the third corner, a second flexible strand of constant width having a first end permanently affixed to the first corner and a second end permanently affixed to the second corner and a third flexible strand of constant length having a first end permanently affixed to the third corner and a second end permanently affixed to the second corner;

sizing said constant lengths of said strands such that at least one angle inside at least one of said corners and between two adjacent said strands has an angular measurement matching the desired angular measurement for at least one corner in the structure to be built;

holding the corner of the tool having the at least one matching angle adjacent a location where a corner of the structure having the same desired angular measurement is to be located;

fully extending each of the strands of the tool; and commencing construction of the structure with sides of the structure adjacent the structure's corner of desired angular measurement oriented along the strands of the tool adjacent the tool corner having the matching angular measurement.

24. The method of claim 23 wherein said holding step includes the steps of providing a grommet in the corner of the tool having the matching angular measurement; and placing a temporary fastener through the grommet and affixed to an element adjacent the corner of the structure to be constructed having the desired angular measurement.

25. The method of claim 24 including the further steps of providing the element of said placing step in the nature of form boards oriented in a vertical plane to support sides of a foundation to be poured with a cementitious material with at least two form boards oriented angularly spaced from each other with an angle of the corner of the tool matching the angle desired for the structure to be constructed, and with a fastener passing through the grommet in the form of a nail extending at least partially into at least one of the form boards adjacent where the two form boards come together; and providing grommets in the second corner and the third corner and positioning nails passing through each of the grommets and into adjacent form boards, with each of the strands fully extended, such that an angular displacement between the two form boards matches a desired angle for the structure.

26. A flexible and collapsible construction geometry tool, consisting essentially of:

a first flexible strand of constant length;

a second flexible strand of constant length;

a third flexible strand of constant length;

said first strand and said second strand permanently affixed together at a first corner;

said second strand and said third strand permanently affixed together at a second corner;

said first strand and said third strand permanently affixed together at a third corner; and one of said corners adapted to measure 90° between adjacent said strands permanently affixed to said corner when each of said flexible strands is extended to be substantially taut.

27. A flexible and collapsible construction geometry tool, consisting of:

a first flexible strand of constant length;

a second flexible strand of constant length;

a third flexible strand of constant length;

said first strand and said second strand permanently affixed together at a first corner;

said second strand and said third strand permanently affixed together at a second corner;

said first strand and said third strand permanently affixed together at a third corner; and one of said corners adapted to measure 90° between adjacent said strands permanently affixed to said corner when each of said flexible strands is extended to be substantially taut.

28. A flexible and collapsible construction geometry tool, comprising:

a first flexible strand of constant length;

a second flexible strand of constant length;

a third flexible strand of constant length;

said first strand and said second strand permanently affixed together at a first corner;

said second strand and said third strand permanently affixed together at a second corner;

said first strand and said third strand permanently affixed together at a third corner; and one of said corners adapted to measure 90° between adjacent said strands permanently affixed to said corner when each of said flexible strands is extended to be substantially taut.

* * * * *